US006824289B2

(12) United States Patent
Vanderschuit

(10) Patent No.: US 6,824,289 B2
(45) Date of Patent: Nov. 30, 2004

(54) BEVERAGE ACCESSORY DEVICE

(76) Inventor: Carl R. Vanderschuit, 751 Turquoise St., San Diego, CA (US) 92109

( * ) Notice: Subject to any disclaimer, the term of this patent is extended or adjusted under 35 U.S.C. 154(b) by 0 days.

(21) Appl. No.: 10/189,822

(22) Filed: Jul. 3, 2002

(65) Prior Publication Data

US 2003/0026088 A1 Feb. 6, 2003

Related U.S. Application Data

(63) Continuation-in-part of application No. 09/627,961, filed on Jul. 28, 2000, now Pat. No. 6,416,198.

(60) Provisional application No. 60/154,424, filed on Sep. 17, 1999.

(51) Int. Cl.[7] ..... F21V 33/00

(52) U.S. Cl. ..... 362/101; 362/96; 362/294; 362/802; 362/276; 362/183; 250/462.1; 441/29

(58) Field of Search ..... 362/101, 234, 362/253, 294, 183, 276, 802, 96; 441/29; 250/462.1

(56) References Cited

U.S. PATENT DOCUMENTS

| | | | | | |
|---|---|---|---|---|---|
| 1,107,645 | A | | 8/1914 | Benedict | |
| 3,099,565 | A | * | 7/1963 | Neuhauser | |
| 3,559,224 | A | * | 2/1971 | Shimizu | 441/17 |
| 3,818,208 | A | * | 6/1974 | Kahl | 240/6.4 G |
| 4,109,405 | A | * | 8/1978 | Ito | 43/17.5 |
| 4,183,316 | A | * | 1/1980 | Bennett | 114/331 |
| 4,409,644 | A | | 10/1983 | Axton et al. | |
| 4,464,131 | A | * | 8/1984 | Plante et al. | 441/29 |
| 4,553,194 | A | * | 11/1985 | Bailey | 362/267 |
| 4,554,189 | A | * | 11/1985 | Marshall | 428/11 |
| 4,733,785 | A | * | 3/1988 | Turner, Jr. et al. | 215/229 |
| 4,761,314 | A | * | 8/1988 | Marshall | 428/11 |
| 4,796,167 | A | * | 1/1989 | Brown et al. | 362/158 |
| 4,827,655 | A | * | 5/1989 | Reed | 43/17.5 |
| 5,070,437 | A | | 12/1991 | Roberts, Sr. | |
| 5,231,781 | A | * | 8/1993 | Dunbar | 43/17.5 |
| 5,295,882 | A | * | 3/1994 | McDermott | 441/16 |
| 5,463,537 | A | | 10/1995 | Trattner et al. | |
| 5,516,317 | A | * | 5/1996 | Moody | 441/2 |

(List continued on next page.)

FOREIGN PATENT DOCUMENTS

| | | | |
|---|---|---|---|
| CH | 662 931 | A | 11/1987 |
| DE | 299 18 185 | U | 1/2000 |
| EP | 0 231 471 | A | 8/1987 |
| EP | 1313986 | | 5/2003 |
| GB | 2381575 | | 5/2003 |
| GB | 2 392 973 | A | 3/2004 |
| WO | WO 93/18358 | A | 9/1993 |
| WO | WO/02/10642 | | 2/2002 |
| WO | PCT/US03/20521 | | 11/2003 |

OTHER PUBLICATIONS

U.S. application No. 10/341,239, Vanderschuit, filed Jan. 13, 2003, pending entitled Mood Enhancing Illumination Apparatus.

U.S. application No. 10/606,314, Vanderschuit, filed Jun. 25, 2003, pending entitled Lighted Hat.

U.S. application No. 10/606,324, Vanderschuit, filed Jun. 25, 2003, pending entitled Lighting Device.

U.S. application No. 10/606,325, Vanderschuit, filed Jun. 25, 2003, pending entitled Lighted Hat.

(List continued on next page.)

*Primary Examiner*—John Anthony Ward
*Assistant Examiner*—Jacob Y. Choi
(74) *Attorney, Agent, or Firm*—Harness, Dickey & Pierce, P.L.C.

(57) ABSTRACT

A beverage accessory device having a housing with a cavity therein, a buoyant filler within the cavity, a buoyancy-reducing feature to incrementally decrease the buoyancy of the device, a straw receptacle attached to the housing, and a switchable light-source within the cavity.

21 Claims, 5 Drawing Sheets

U.S. PATENT DOCUMENTS

| | | | | | |
|---|---|---|---|---|---|
| 5,622,422 | A | * | 4/1997 | Rodgers | 362/158 |
| 5,636,770 | A | * | 6/1997 | Hachinohe et al. | 222/402.1 |
| 5,697,182 | A | | 12/1997 | Rodgers | |
| 5,860,724 | A | | 1/1999 | Cheng | |
| 5,903,212 | A | | 5/1999 | Rodgers | |
| 5,934,519 | A | * | 8/1999 | Kim et al. | 222/464.4 |
| 5,971,827 | A | * | 10/1999 | Lee et al. | 446/81 |
| 6,116,753 | A | * | 9/2000 | Tsang | 362/253 |
| 6,354,460 | B1 | * | 3/2002 | Cornell et al. | 220/706 |
| 6,375,092 | B1 | * | 4/2002 | Banach | 239/33 |
| 6,416,198 | B1 | * | 7/2002 | Vanderschuit | 362/101 |
| 6,481,148 | B1 | * | 11/2002 | Lindgren | 43/17.5 |

OTHER PUBLICATIONS

United Kingdom Combined Search and Examination Report dated Jan. 6,2004; Application No. GB 0326549.3; 4 pages.

U.S. application No. 10/786,995, Vanderschuit, filed Feb. 25, 2004, pending entitled Therapeutic Device and Methods for Applying Therapy.

U.S. application No. 10/797,254, Vanderschuit, filed Mar. 10, 2004, pending entitled Lighted Balloons.

Supplementary European Search Report dated Mar. 1, 2004; App. No. EP 01 93 9305; 3 pages.

The Written Opinion for International Application PCT/US01/16640, dated Apr. 25, 2002.

International Preliminary Examination Report for International Application PCT/US01/16640, dated Jan. 27, 2003.

International Search Report dated Nov. 3, 2003 from PCT Application Ser. No. PCT/US03/20521 filed Jun. 27, 2003, claiming priority to U.S. application No. 10/189,822.

* cited by examiner

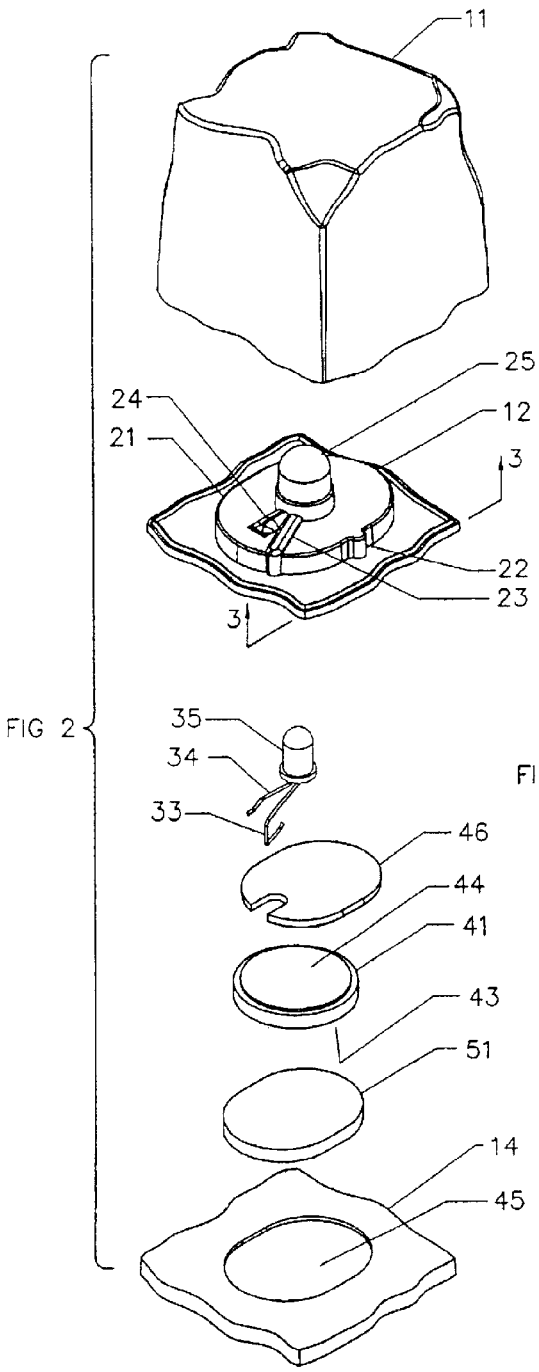
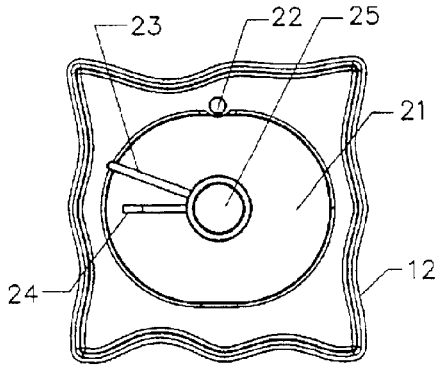
FIG 3
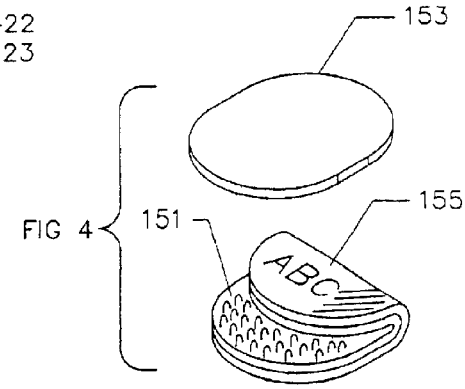
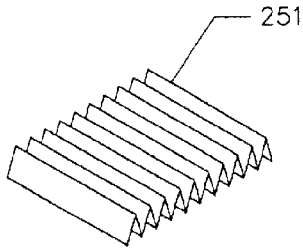
FIG 5

BEVERAGE ACCESSORY DEVICE

CROSS REFERENCES TO RELATED APPLICATIONS

This application is a non-provisional continuation-in-part application of my U.S. non-provisional application, application Ser. No. 09,627,961, filed on Jul. 28, 2000, which issued on Jul. 9, 2002 as U.S. Pat. No. 6,416,198, which application was a non-provisional application of a provisional application, application No. 60/154,424, filed on Sep. 17, 1999.

STATEMENT REGARDING FEDERALLY-SPONSORED RESEARCH OR DEVELOPMENT

Not applicable

BACKGROUND OF THE INVENTION

This present invention relates to a novelty-related accessory for use in containers filled with a liquid substance; i.e. drinks, and is an improvement over prior novelty-related devices. In particular, the device of the present invention is buoyant, has buoyancy-control, is illuminatable by a light-source or through glow-like characteristics of its interior, is heatable and will retain its heat, is coolable and will retain its coolness, and may serve as a drinking facilitator.

Currently there are several prior art novelty-related devices resembling an ice cube. These are either complex in structure or in use or both. U.S. Pat. No. 5,800,724 issued to Cheng describes a luminescent light emitter shaped like an ice cube having several chambers within, each filled with chemicals which, when mixed, emit light. Though suited for the Intended purpose, it is of complex construction, requiring chemicals, and Is a relative burden to use. U.S. Pat. No. 5,903,212 issued to Rodgers is even more complex. It is motion-sensitive. The device is powered by any motion through a motion-responsive ball-switch within. After the device is illuminated, a timer controls the duration of light emission. This device Is relatively easy to use but is extremely complex in structure. A need still exists for novel beverage accessories which have buoyancy control, assist in the drinking process, and provide illumination or mood enhancers all to provide visual pleasure to one's other sensory pleasures while relaxing consuming a beverage; particularly, those novelty items resembling an Ice cube for use in a drink.

Accordingly, several objects and advantages of my invention are to:

a. control the buoyancy of a device immersible in a liquid;

b. assist or facilitate the physical action of drinking a beverage;

c. provide an easy-to-use illuminatable novelty device to enhance the atmosphere of an occasion;

d. enhance one's enjoyment while consuming a beverage;

e. provide for all to use an inexpensive pleasurable novelty device;

f. create a unique promotional novelty device adapted to convey messages to users; and g. assist in heating or cooling a beverage.

The foregoing has outlined some of the more pertinent objects of the present invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF SUMMARY OF THE INVENTION

The above-noted problems, among others, are overcome by the present invention. Briefly stated, the present invention contemplates a beverage accessory device having a housing with a cavity therein, a buoyant filler within the cavity, a buoyancy-reducing feature to incrementally decrease the buoyancy of the device, a straw receptacle attached to the housing, and a switchable light-source within the cavity.

The foregoing has outlined the more pertinent and important features of the present invention in order that the detailed description of the invention that follows may be better understood so the present contributions to the art may be more fully appreciated. Additional features of the present invention will be described hereinafter which form the subject of the claims. It should be appreciated by those skilled in the art that the conception and the disclosed specific embodiment may be readily utilized as a basis for modifying or designing other structures and methods for carrying out the same purposes of the present invention. It also should be realized by those skilled in the art that such equivalent constructions and methods do not depart from the spirit and scope of the inventions as set forth in the appended claims.

BRIEF DESCRIPTION OF THE DRAWINGS

For a fuller understanding of the nature and objects of the invention, reference should be had to the following detailed description taken in conjunction with the accompanying drawings in which:

FIG. 2 is an exploded view of the beverage accessory.

FIG. 3 is a planar view of a portion of the beverage accessory as taken on line 3—3 of FIG. 2.

FIG. 4 is an exploded detail view of a support member for the power source of the beverage accessory.

FIG. 5 is a detailed view of another embodiment of a support member for the power source of the beverage accessory.

DETAILED DESCRIPTION OF THE INVENTION

Figure 1:
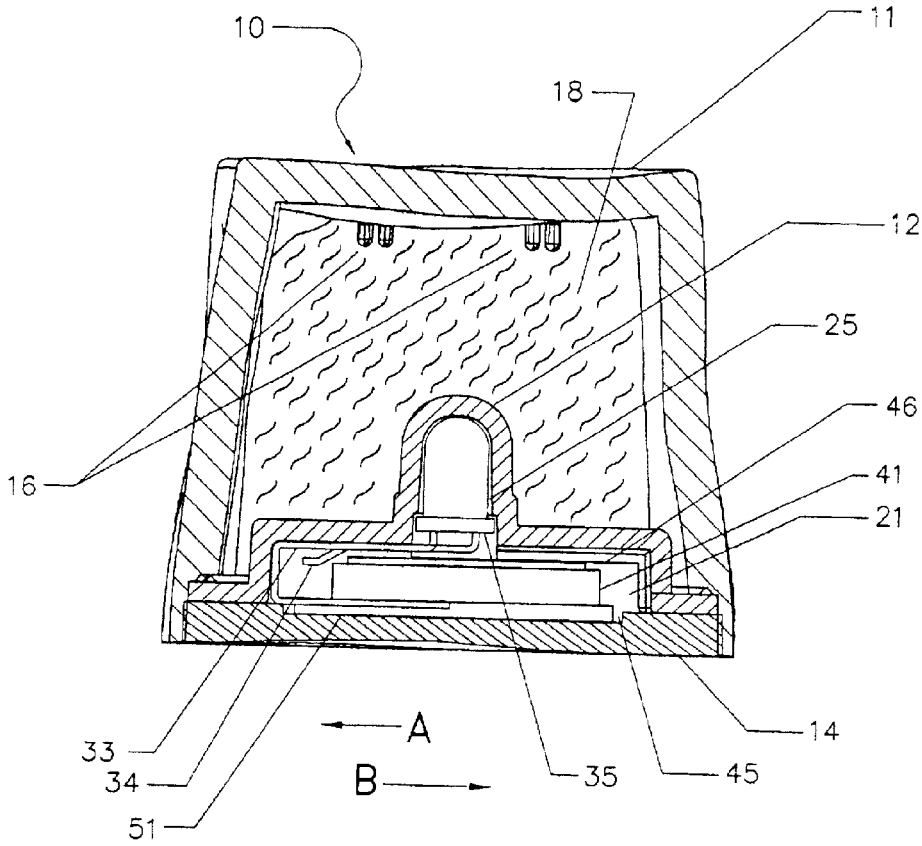
FIG. 1 is a cross-sectional view of the beverage accessory.

Referring now to the drawings in detail and in particular to FIG. 1, reference character 10 generally designates a novelty item beverage accessory device constructed in accordance with one embodiment of the present and co-pending invention as described in detail in my co-pending application Ser. No. 09/627,961 and as described herein. The novel elements of the present invention may encompass all or some or none of the elements of my co-pending application or may stand alone or any combinations thereof. The newer novel elements of the present invention are particularly illustrated in FIGS. 11—15 and are described later.

With regard to FIG. 1; FIG. 1 shows a housing 11 which rests on a lid 14. Within the housing 11 seated on the lid 14 is a cartridge 12. A cavity is, though need not be, formed above the cartridge 12. A cavity is preferred but the space above the cartridge 12 also may be part of the inner housing itself—a single-piece or of a solid construction fitted onto or be a part of the cartridge 12. This solid inner housing may be transparent or translucent and/or comprise any one or more colors or tints or shades.

The cartridge 12 can be fixedly sealed to the lid 14 and each, the cartridge 12 and the lid 14, can be fixedly sealed to the housing 11 thereby creating a water-tight integrity for the beverage accessory device 10. It must be understood, however, that any one or more of these parts (that is, the housing 11, the cartridge 12, and the lid 14) may be removably attached to any one or all of the other parts, or fixedly attached to any one or all of the others, or in any combination thereof. For maintaining water-tight integrity, a fixed seal is preferred.

Reference is now made to FIGS. 1–3. Within the cartridge 11 is a light-source chamber 25, a power-source chamber 21, a detent 22 or similar structure suited for the intended purpose of restricting the (unwanted) movement of the power-source 41 (having a negative terminal or cathode 44 and a positive terminal or anode 43) within the power-source chamber 21, and wire lead channels 23, 24 adapted to receive the respective wire leads 33, 34 from the light source 35. The light source 35 seats into the light-source chamber 25. Its wire leads 33, 34 seat into the respective wire lead channels 23, 24 of the underside of the cartridge 12. The power source 41 is seated into the power-source chamber 21 directly below the light source 35. The power-source chamber 21 is sized such that the power source 41 may slide from one side to another side as depicted by direction arrows A and B in FIG. 1 (for reference purposes only, and not by way of limitation, this figure depicts a right to left translation of the power source 41 and in this vein, the power-source chamber 21 is slightly longer than the length of the power source 41). Side to side length of the power-source chamber 21 is slightly less than the length of the power source 41 to provide the clearance necessary to permit movement in directions A and B when desired. Undesired movement within the power-source chamber 21 of the power source 41 is restricted by placement of a detent 22 within the power-source chamber 21, or similar structure suited for the intended purpose such as, but not limited to a nub, a bias member, a pin, and the like. Those skilled in the art, however, will recognize that any restricting-type mechanism suited for the intended purposes may be employed and are not limited to these forms of restricting-type mechanisms described above.

One wire lead (for example purposes only, and not by way of limitation, it is wire lead 33) extends from the light source 35 around the inner perimeter of the power-source chamber 21 to the bottom of the power source 41 as follows: from upper chamber wall to the left side wall then down to the bottom chamber wall and then to the right. This wire lead 33 is in continuous communication with one terminal of the power source (for example purposes only, and not by way of limitation, the wire lead 33 communicates with the positive terminal on the bottom of the power source 41). Below the power source 41 and inside the lid chamber 45 is a bias member 51. The bias member 51 is seated in the lid chamber 45 and is adapted to apply force on and/or support to the power source 41 such that the power source 41 does not and cannot easily move or translate from side to side (directions of arrows A or B) unless external force is applied to overcome the force and support being applied by the bias member 51 to then cause such movement.

Wire lead 34 from light source 35 in this example is the negative lead and seats in lead channel 34 of the underside of the cartridge 21. As illustrated in FIG. 1, this wire lead 34 is positioned well away from contact with the power source 41 when power source 41 is, by way of this example only, in the full right side position (moved fully in the direction of arrow B). This wire lead 34 is slightly downward angled left of center such that, when the power source 41 is slid in the direction of arrow A, the top side (in this example, the negative terminal) of the power source 41 contacts this wire lead 34 thereby completing the circuit causing the light to power 'on'. When the power source is slid sufficiently in the direction of arrow B, contact between the wire lead 34 and the negative terminal of the power source 41 is broken and light emission from the light source 35 will terminate. To prevent undesired contact between wire lead 33 (positive in this example) and the negative terminal of the power source (top in this example) and undesired contact between wire lead 34 (negative lead in this example) and the negative terminal of the power source 41 (top in this example) an insulator has been inserted on the top (as viewed from the perception of FIG. 1) of the power-source chamber 21 between the two wire leads 33, 34 and the top of the power source 41. The insulator 46, however, should extend approximately up to wire lead 33 at a point where it is desired that the wire lead 33 come in contact with the top of the power 41 when the power source 41 is caused to move in direction A (in this example, and not by way of limitation, this point is approximately where the downward angling of wire lead 33 begins).

The beverage accessory device is preferably formed from biologically safe material, such as, but not limited to, polymers or any other material suited for the intended purpose which has properties suitable for placing it in contact with a material that is to be ingested and falls under the Food and Drug Administration food-contact grade properties. The beverage accessory device also could be manufactured from, or filled with, a material capable of maintaining cold or heat if the beverage accessory device is cooled or heated as the case may be. As such, the beverage accessory device could impart such properties to a drink if desired. As stated earlier, the housing 11 may be hollow; that is, have a cavity within and above the cartridge 12. In such cases, the cavity may be filled with a filler 18 such as, but not limited to, water, jell, powder, metals, heat-retaining materials, cold-retaining materials, ultra-violet materials, materials having a fluorescent or glow-in-the-dark quality and the like, all may be either colored or clear or translucent or any combination thereof. Depending on the material used, such filler 18, if frozen or heated, could impart greater cooling or heating properties, respectively, than a solid housing 11. For cooling and heating properties, any commercially available material bearing cold-retaining or heat-retaining properties will suffice, such as, but not limited to, materials generally used in re-usable ice-packs and heating pads. Those skilled in the art, however, will recognize that any filler suited for the intended purposes may be employed and are not limited to these forms of fillers described above. [Glow-in-the-dark fillers of varying colors are well-suited for mood enhancing. Buoyant fillers are well-suited to establish positive buoyancy such that the device will float within the liquid. Any convention fillers suited for the intended purpose and purposes will suffice.]

Having a solid inner housing 11 or a filler 18 within creates a negative buoyancy to the beverage accessory device. Adjusting such combinations of filler 18 and/or solid inner housing 11 or retaining an unused cavity would generally create a positive buoyancy for the beverage accessory device. Since the beverage accessory device could be used as a novelty ice cube, its outer features could simulate the contours and somewhat curved corners of a real ice cube. It could resemble that of a melted or partially melted or melting ice cube complete with a convoluted exterior surface. Shape, for this purpose, would enhance the pleasure of its use. Indicia, external or internal, could be displayed by the beverage accessory device. Such indicia could impart holiday themes, professional themes, promotional themes, sports related themes, and the like. Those skilled in the art, however, will recognize that any theme suited for the intended purposes may be employed and are not limited to these types of themes described above.

In an embodiment where the lid chamber 45 is somewhat or completely transparent, the portion of the bias member 51 which is exposed to the lid chamber 45 (bottom of bias member 51 for example) could contain any indicia which, as a result of the transparency of the lid chamber 45, is exposed to outside viewers. As above, such indicia also could impart holiday themes, professional themes, promotional themes, sports related themes, and the like. This bottom of the bias member 51 could be of a glossy surface, a non-glossy surface, smooth, or textured, or any combination thereof.

In an embodiment where the inner housing 11 is a cavity, a display mechanism 16 may be connected to any one or more side walls or the top of the housing 11. The display mechanism is adapted to receive and hold, but is not limited to, a display placard, plaque, card, any two- or three-dimensional objects, and the like, or any combination thereof which may convey a message, project an image or impression, or to merely bring entertainment to the user of the beverage accessory device; to the user. Any display mechanism suited for the intended purpose will suffice, including, but not limited to, clips, slots, hooks, rollers, tabs, and the like. Those skilled in the art, however, will recognize that any display mechanism suited for the intended purposes may be employed and are not limited to these forms of display mechanisms described above.

The light source 35 can be any source which can illuminate the beverage accessory device and preferably the surrounding environment into which the beverage accessory device is placed; into a drink (floating or not), in a planter, in a fish bowl, on a dinner table, at a picnic, and the like. Any light source 35 suited for the intended purpose will suffice, such as, but not limited to light-emitting diodes (LED's), fiber optics, halogen, incandescent, laser, fluorescent, magnetic, and the like. It is preferred, however, that the light source 35 not impart excessive or undesired heat or temperature to the beverage accessory device and the surrounding liquid or drink. An LED is preferred, however, those skilled in the art will recognize that any light source mechanism suited for the intended purposes may be employed and are not limited to these forms of light source mechanisms described above.

The power source 41 contemplates any means of providing energy to the light source 35 to thereby cause the light source 35 to emit light. An power source 41 suited for the intended purpose will suffice including, but not limited to, renewable batteries, rechargeable batteries, disposable batteries, power cells, and the like. If rechargeable, such power source 41 should be rechargeable by solar, magnetic, electrical, and chemical means, and the like or any combination thereof. One embodiment directs that the power source 41 be fully contained within the beverage accessory device and not to be in contact with its external environment. Those skilled in the art will recognize, however, that any power source mechanism suited for the intended purposes may be employed and are not limited to these forms of power source mechanisms.

The bias member 51 may be comprised of any suitable material or structure suited for the intended purpose such as, but not limited to a spring, a resilient pad, a single piece of VELCRO material, a foam pad, a corrugated plate, a spring plate, and the like or any combination thereof. In the preferred embodiment a foam-like member 51 is used. A typical foam-like member may be, but is not limited to, rubber, vinyl, polyethylene polyester, styrofoam, and the like, or any combination thereof. A single piece of VELCRO material 151 (that is, the hook side of a hook-and-loop VELCRO, or the loop side of a hook-and-loop VELCRO) may also be used (see FIG. 4). In such case, a cover 153 would be placed on the VELCRO portion of this material. The VELCRO portions give this element the spring-like quality necessary to apply pressure or force to the power source 41 to thereby, in the process, provide support for the power source 41 within the power-source chamber 21 and prevent unwanted movement. Printed indicia, as explained above, would be on the reverse side 155. FIG. 5 illustrates another type of bias member, that of a corrugated plate-like member 251. What is necessary for the support is application of upward force on the power source 41 to prevent it from moving when movement is not desired. Those skilled in the art will recognize, however, that any force applying mechanisms suited for the intended purposes may be employed and are not limited to these forms of bias member mechanisms.

Once the beverage accessory device is so constructed, a user would pick it up and strike an edge (for illustration purposes only, and not by way of limitation, we will adhere to relative positions of FIG. 1). To illuminate the beverage accessory device, the user would move the beverage accessory device in the direction of arrow A and strike the left side of the beverage accessory device on any suitable somewhat rigid surface. The force of this blow causes the power source 41 to slide from its right-most position, in the direction of arrow B to the left and cause the negative terminal of the power source 41 to contact the negative lead wire 33. Light thereupon is emitted. To turn off the light, the user strikes the right side of the beverage accessory device (direction of arrow B) causing the power source 41 to return to the right inside the power-source chamber 21. Contact between the negative wire lead 33 and the negative terminal of the power source 41 is broken and the light thereupon extinguished. Those skilled in the art will recognize, however, that multiple switch mechanisms suited for the intended purposes, such as magnetic switches, mechanical switches, and electrical switches, and the like, may be employed and are not limited to this translating-type switch mechanism.

FIGS. 6–10 illustrate a conventional 'push-button' type power switch device 63. What has been described before with regard to the beverage accessory device which bears the same reference numerals for FIGS. 6–10 apply to this embodiment and are incorporated by reference. What distinguishes this embodiment from the previously discussed embodiment is the switch-facilitating mechanism comprising a mechanical switch device 63, on a foundation member 61, which is seated into a ledge 65 in the lid chamber 45. Any conventional switch device 63 will suffice. For this embodiment, however, a 'push-button' style is preferred. Here the positive lead wire 33 from the light source 35 is hard-wired into the foundation member 61 and connected to the switch device 63. Reference point 73 is the solder point for the positive lead wire 33 to the foundation member 61; reference point 74 is the solder point for the negative lead wire 34 to a clip-like member 84 which generally maintains constant contact with the power source 41. The power source 41 is held firmly in place thereat and, when switch device 63 is switched on or off, the light source 35 goes on or off as the case may be.

The clip-like member 84 is configured such that it seats firmly on the power source 41. It must be understood, however, that though the negative wire lead 34 is shown to be in constant contact with the power source 41 via the clip-like member 84, this configuration may be reversed and the positive wire lead 33 may be in constant contact with the power source 41 via the clip-like member 84 instead.

Figure 6:
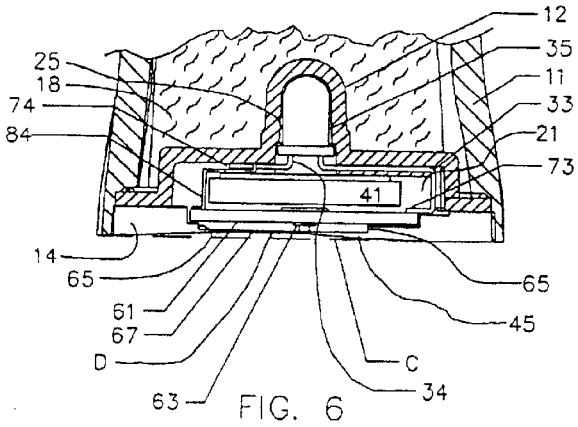
FIG. 6 is a detailed partial view of another embodiment of the beverage accessory.
Figure 8:
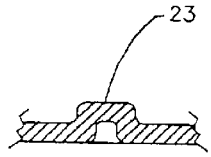
FIG. 8 is a detailed view of a lead chamber in the beverage accessory as taken on line 8—8 of FIG. 7.
Figure 9:
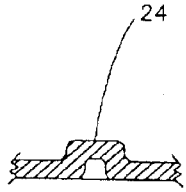
FIG. 9 is a detailed view of another lead chamber in the beverage accessory as taken on line 9—9 of FIG. 7.
Figure 7:
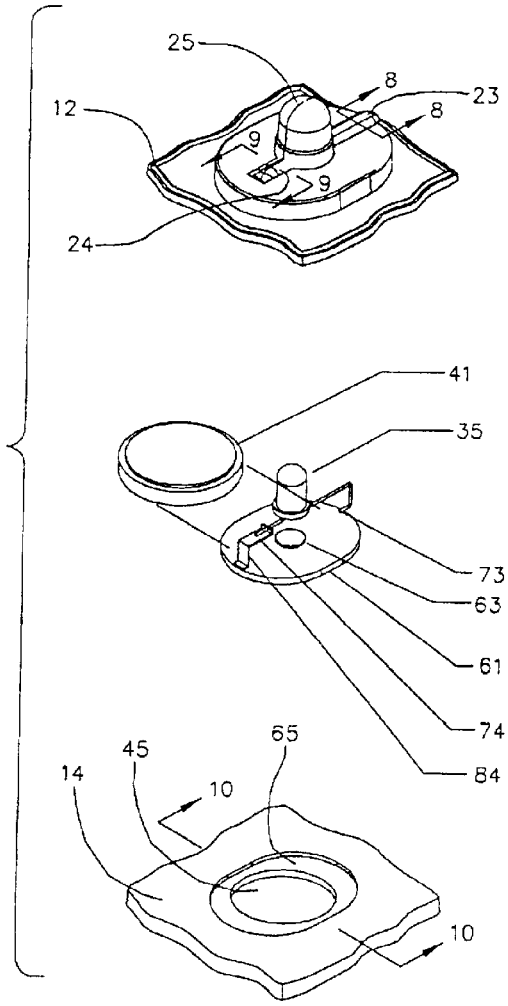
FIG. 7 is an exploded view of the second embodiment of the beverage accessory.
Figure 10:
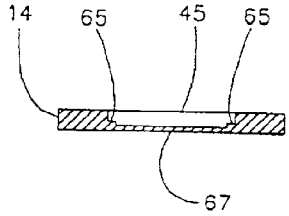
FIG. 10 is a detailed view of the lid as taken on line 10—10 of FIG. 7.

The lid 14 in this embodiment has a lid chamber 45 with a step or ledge 65. As was described, the foundation member 61, with switch device 63 in place, seats into the lid chamber 45 on the ledge 65. The switch device 63 is adjacent to the bottom of the lid chamber 45. The bottom of the lid chamber 45 here is relatively thin (or membrane-like 67) such that it flexes to the touch and exertion of some external pressure. The purpose of this resiliency and flexibility is to permit a user to contact the internal switch device 63 from the outside and to thereby switch the light source 35 'on' or 'off'. FIG. 6, reference character C (represented by phantom line) illustrates the position of the thin layer 67 in its normal position; reference character D illustrates its position after external pressure is exerted on the thin layer 67.

Figure 11:
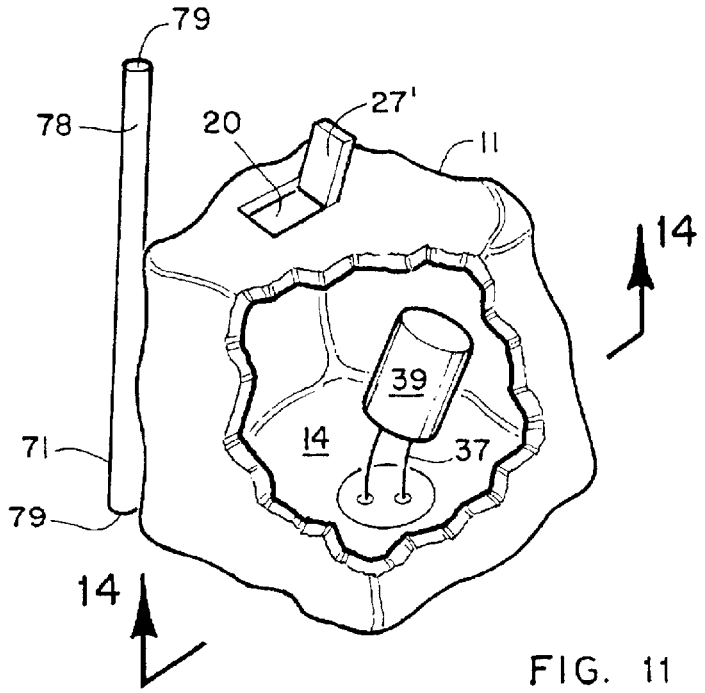
FIG. 11 is a cut-away perspective view of the device highlighting the encapsulated light- and power-source and drink facilitating attached straw.

The preferred embodiments of the new and novel features of the present invention are best represented in FIGS. 11–15, though any one or more of the previously described embodiments, components, elements, and features also may be employed with the preferred embodiments of the present invention now to be described. In these embodiments, the inside of the housing 11 is hollow, defining a cavity therein. A filler 18, generally, will be inside the cavity. FIG. 11, the cavity within the housing 11 is exposed revealing the container 39. The container generally houses the light-source 35, the power-source 41, and may also, but need not, house the power switch member 163. These components 35, 41, 163 are shown to be encapsulated within the container 39 and, preferably (though not necessarily), in a water-tight fashion. For greater clarity, the filler 18 earlier described is not illustrated in these figures but is necessary when buoyancy is desired, when heat-retaining and cold-retaining features are desired, or when a glow-in-the-dark feature is desired, or any one or more of the above in any desired combination. Buoyancy also may be attained having an empty cavity. The filler 18, however, maintains the container 39 in suspension within the housing 11. In this regard, the container may be adjacent to any inside wall of the housing 11 (top, bottom, sides) and suspended anywhere within. [The filler 18 generally should have buoyant characteristics, may have heat-retaining and cold-retaining characteristics, and may have glow-in-the-dark characteristics. Additionally, glass-like prisms, particles, colored or clear, may be inserted within the cavity, with or without a filler. The light-source, when activated, is reflected and/or refracted to create yet an additional feature].

Figure 14:
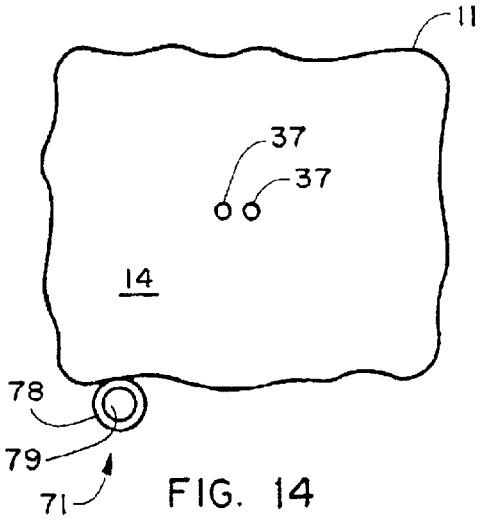
FIG. 14 is a bottom plan view of the device taken on line 14—14 of FIG. 11.
Figure 15:
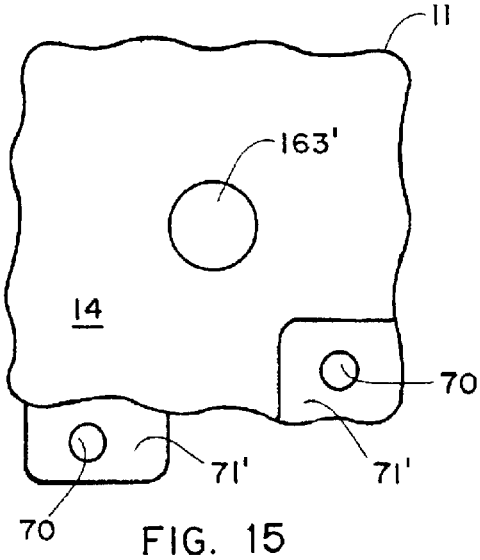
FIG. 15 is a bottom plan view of the device taken on line 15—15 of FIG. 12.

Conductive members 37 establish an on-off (switchable) connection between the power-source 41, the light-source 35, and a user. The switch member 163 may be manually activated by a user manually engaging a reciprocating switch, a push-button switch 163', or the like, each of which are accessible to a user from outside the housing 11. The switch member 163 also may be automatically activated by immersion of the device into a liquid which causes contact between the conductive members to, depending on the mechanism used, interrupt a circuit and cause power to be delivered to the light-source 35; or to complete the circuit and deliver power to the light-source 35. FIG. 14 represents the structural feature and function of an automatically-operated switching function (i.e., by placing into a liquid, by covering with one's hand or finger, etc.). FIG. 15 represents the structural feature and function of one type of manually-operated switching function (i.e., a push-button type switch 163').

Any conventional chip or microprocessor is suited to function as the switch member 163 whether to be manually operated or automatically triggered. Typical such microprocessors are Model PEK 123508 manufactured or distributed by MicroChip; a Basic Discrete Logic Nand-Gate by MicroChip; or any 8-pin chips manufactured or distributed by Holtech. With the container 39 and its components all inside the housing 11, the light 35 may be illuminated automatically by immersing the device into a liquid; or if a manual push-button device is used, the light is illuminated by depressing the push-button device 163'. Many such switches may have a timer to regulate the duration of illumination, others may have a power-interrupting source such as a strobe to cause the illumination to flicker or strobe.

The power-source 41 may be solar powered, may be rechargeable, may be permanently affixed to the device, or may be removable, or any compatible combination or combinations thereof. [If a rechargeable power-source is used it may be permanently affixed and recharged by placing the entire device on a cooperating and compatible charging device. If a rechargeable power-source is used it may be removable and placed directly on a cooperating and compatible charging device. If removable, the device in such configuration also would encompass a lid 14 which also is removable.]

Buoyancy-reduction may be realized in several ways. One manner provides for a removable lid 14 to expose the cavity and filler 18. Any type of weight (ballast) 47, in any number, may be inserted into the cavity to decrease buoyancy to any desired degree such that the device floats in a liquid on the surface, just below the surface, sinks to the bottom, or to any level between the surface and the bottom. The greater the density of the ballast 47, the more in number of the ballast 47, the less buoyancy for the device.

Figure 12:
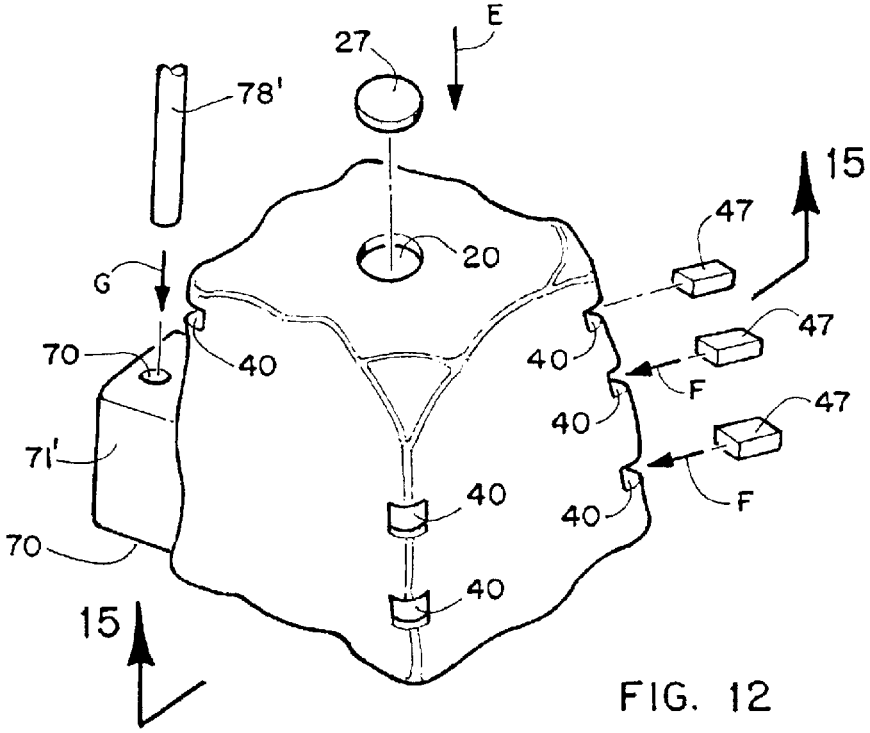
FIG. 12 is a perspective view of another embodiment of the device highlighting the buoyancy-reducing component and drink facilitator.
Figure 13:
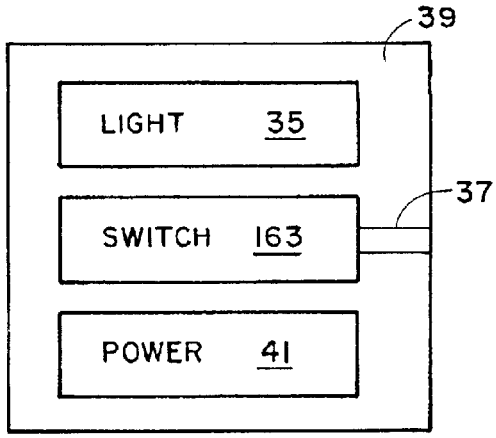
FIG. 13 is a schematic of the light, power, and switching components of the device.

Insertion of the ballast 47 may also be accomplished through an opening 20 on the housing 11 which, when in an open position, exposes the cavity and filler 18 within to the environment. When in the open position, any type and number of weights (ballast) 47 may be inserted until the desired buoyancy level is attained. The opening 20 is secured into a closed position by a cap 27, 27' (FIGS. 12 and 11, respectively). The closed position is such that the device maintains a water-tight integrity (i.e., no water or liquid [or virtually no water or liquid] enters the cavity of the device when the device is immersed into the water or liquid). As illustrated in FIG. 11, the cap 27' is a cap or door-like member hingedly-connected to the opening 20. It opens and closes on the hinge and maintains a secure closure by friction-fit or by cooperating grooves and ribs or detents around the opening 20 and the cap 27'. FIG. 12 illustrates a cap 27 which is not hingedly-connected to the opening 20 but is completely removable from the opening 20. The cap 27 may be friction-fitting to the opening 20, may incorporate cooperating grooves and ribs or detents as above described, or may incorporate cooperating threading to be screwed on (into the closed position) and off (into the open position) as desired. It is inserted over the opening 20 by movement in the direction of Arrow E until firmly seated on or into the opening 20. Though the respective caps 27', 27 are shown as being rectilinear and curvilinear in shape, they may encompass any shape and may be placed anywhere on the device provided an open position and a closed position may be achieved and a water-tight integrity is or may be attained and maintained if desired. In either case, the device may be an empty cavity into which a liquid, as a ballast, is introduced through the opening 20 and suitably sealed. The amount of buoyancy will depend upon the amount of water introduced.

FIG. 12 also illustrates another buoyancy-reducing feature of the present invention. Illustrated here are a plurality of slots or slits 40 adapted to receive the designated ballast 47. The slot 40 and respective ballast 47 are sized such that the ballast 47 firmly seats and remains in the slot 40. A user merely inserts any number of ballast members 47 or any type into one or more slots 40 (in the directions of Arrows F) until the desired level of buoyancy is attained.

An additional feature for the present invention is the straw receptacle 71 attached to the housing 11 or to the lid 14. As illustrated in FIG. 11, the straw receptacle 71 is an elongated tube 78 extending away from the device. The elongated tube 78 has an opening or channel 79 completely therethrough from top to the bottom. As illustrated here, the straw receptacle 71 comprises a single straw-like member (elongated tube) 78. The straw receptacle 71 may also encompass a larger block-like structure 71' as illustrated in FIGS. 12 and 15. With the block-like structure 71' an elongated tube 78 may extend away from the block-like structure 71' provided the channel 79 of the elongated tube 78 extends completely through the block-like structure 71'. This provides for a stronger and more durable straw feature for the device to facilitate or assist one in consuming the beverage into which the device has been placed.

Referring to FIG. 12, the straw receptacle 71' as a block-like structure may also be structured without a permanent elongated tube 78 thereon but may have an aperture 70 running completely through the straw receptacle 71', which aperture 70 is adapted to receive and hold an externally introduced straw 78' (in the direction of Arrows G as illustrated in FIG. 12).

The present disclosure includes that contained in the present claims as well as that of the foregoing description. As can be gleaned, the device has multiple functions. If constructed of water-tight integrity, it can be placed into liquids. It can accept and maintain an external drinking implement (such as a straw) to facilitate drinking or sipping a beverage. Buoyancy of the device may be controlled to permit the device to float on top of a beverage or to submerge to any suitable depth depending on the amount of ballast or weight placed on or into the device. Whether or not of water-tight integrity, it can be used to enhance moods, provide visual pleasure or serenity, or provide numerous novelty-related results. If appropriate fillers are used, it can also impart heating or cooling or glow-like illumination properties to its adjacent environment. Its external shape also can be altered to facilitate a particular use and it can provide and display messages to others. The principal use envisioned, however, is that of a simulated ice cube or ice berg, or a test-tube-like or capsule-like structure, a food substance (such as, but not limited to, an olive or onion), dice, and the like, of any size and shape, which is immersible in a liquid (to sink or float, depending on how constructed) and is illuminatable at will by a user. The configuration is limited only by one's imagination.

Although this invention has been described in its preferred forms with a certain degree of particularity, it is understood that the present disclosure of the preferred forms has been made only by way of example and numerous changes in the details of construction and combination and arrangement of parts may be resorted to without departing from the spirit and scope of the invention. Accordingly, the scope of the invention should be determined not by the embodiment[s] illustrated, but by the appended claims and their legal equivalents.

What is claimed is:

1. A beverage accessory device comprising:

a housing with a lid enclosing said housing defining a water-tight cavity therein;

a buoyant filler within said cavity;

one or more weight members; and a ballast means for incrementally decreasing buoyancy of said device, wherein said ballast means comprises a plurality of slots outside of said housing, said plurality of slots adapted to receive said one or more weight members.

2. A beverage accessory device comprising:

a housing with a lid enclosing said housing defining a water-tight cavity therein;

a buoyant filler within said cavity; and a ballast means for incrementally decreasing buoyancy of said device, wherein said ballast means comprises an opening on said housing in communication with said cavity for receiving into said cavity one or more weight members and further comprises a sealing member for said opening for exposing said cavity via said opening when said sealing member is in an open position and for securing said opening when said sealing member is in a closed position.

3. A beverage accessory device comprising:

a housing with a lid enclosing said housing defining a water-tight cavity therein;

a buoyant filler within said cavity;

a container within said housing, said container comprising a light-source and a power-source for said light-source; and ballast means for incrementally decreasing buoyancy of said device.

4. The device as claimed in claim 3 further comprising one or more weight members, and wherein said ballast means comprises a plurality of slots outside of said housing, said plurality of slots adapted to receive said one or more weight members.

5. The device as claimed in claim 3 wherein said ballast means comprises an opening on said housing in communication with said cavity for receiving into said cavity one or more weight members and further comprises a sealing member for said opening for exposing said cavity via said opening when said sealing member is in an open position and for securing said opening when said sealing member is in a closed position.

6. The device as claimed in claim 3 wherein said filler is further comprised of a substance adapted to glow in the dark.

7. A beverage accessory device comprising:

a housing with a lid enclosing said housing defining a water-tight cavity therein;

a straw receptacle on said housing;

a buoyant filler within said cavity; and a ballast means for incrementally decreasing buoyancy of said device, wherein said ballast means comprises an opening on said housing in communication with said cavity for receiving into said cavity one or more weight members and further comprises a sealing member for said opening for exposing said cavity via said opening when said sealing member is in an open position and for securing said opening when said sealing member is in a closed position.

8. A beverage accessory device comprising:

a housing;

at least one light source within the housing;

at least one ballast;

wherein coupling the ballast with the housing decreases buoyancy of the beverage accessory device, wherein decoupling the ballast from the housing increases buoyancy of the beverage accessory device, and wherein the housing defines at least one slot adapted to receive the ballast.

9. A beverage accessory device comprising:

a housing;

at least one light source within the housing;

at least one ballast;

wherein coupling the ballast with the housing decreases buoyancy of the beverage accessory device, wherein decoupling the ballast from the housing increases buoyancy of the beverage accessory device, wherein the housing defines at least one opening to allow the ballast to be positioned within or removed from the housing, and wherein the beverage accessory device further comprises a cap for exposing the opening when the cap is in an open position and for closing the opening when the cap is coupled to the housing in a closed position.

10. A beverage accessory device comprising:

a housing;

at least one light source within the housing;

at least one ballast;

a removable lid coupled to the housing to expose a cavity within the housing;

wherein the ballast is sized to be received within the cavity, wherein coupling the ballast with the housing decreases buoyancy of the beverage accessory device, and wherein decoupling the ballast from the housing increases buoyancy of the beverage accessory device.

11. The device of claim 10 wherein the housing includes an external surface adapted to resemble an ice cube.

12. The device of claim 2 further comprising a substantially water-tight container within the housing, the container including a light source and a power source for powering the light source.

13. The device of claim 2 wherein the one or more weight members are within the cavity, and the sealing member is coupled to the housing to create a substantially fluid-tight seal between the sealing member and the housing.

14. The device of claim 2 wherein the ballast means comprises a fluid.

15. The device of claim 9 wherein the ballast is within the housing, and the cap is coupled to the housing to create a substantially fluid-tight seal between the cap and the housing.

16. The device of claim 10 wherein the lid extends across and forms a bottom surface of the beverage accessory device.

17. The device of claim 10 wherein the ballast is within the housing, and the lid is coupled to the housing to create a substantially fluid-tight seal between the lid and the housing.

18. The device of claim 2 further comprising a light source, and wherein the ballast means comprises one or more batteries for powering the light source.

19. The device of claim 3 wherein the ballast means comprises one or more batteries for powering the light source.

20. The device of claim 9 wherein the ballast comprises one or more batteries for powering the light source.

21. The device of claim 10 wherein the ballast comprises one or more batteries for powering the light source.

* * * * *